US009620134B2

(12) United States Patent
Chebiyyam et al.

(10) Patent No.: US 9,620,134 B2
(45) Date of Patent: Apr. 11, 2017

(54) GAIN SHAPE ESTIMATION FOR IMPROVED TRACKING OF HIGH-BAND TEMPORAL CHARACTERISTICS

(71) Applicant: QUALCOMM Incorporated, San Diego, CA (US)

(72) Inventors: Venkata Subrahmanyam Chandra Sekhar Chebiyyam, San Diego, CA (US); Venkatraman S. Atti, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 59 days.

(21) Appl. No.: 14/508,486

(22) Filed: Oct. 7, 2014

(65) Prior Publication Data

US 2015/0106102 A1 Apr. 16, 2015

Related U.S. Application Data

(60) Provisional application No. 61/889,434, filed on Oct. 10, 2013.

(51) Int. Cl.

| | |
|---|---|
| ***G10L 19/02*** | (2013.01) |
| ***G10L 13/00*** | (2006.01) |
| ***G10L 19/04*** | (2013.01) |
| ***G10L 21/038*** | (2013.01) |

(52) U.S. Cl.

CPC ..... *G10L 19/02* (2013.01); *G10L 13/00* (2013.01); *G10L 19/0208* (2013.01); *G10L 19/04* (2013.01); *G10L 21/038* (2013.01)

(58) Field of Classification Search

CPC ..... G10L 21/038

See application file for complete search history.

(56) References Cited

U.S. PATENT DOCUMENTS

| | | | |
|---|---|---|---|
| 6,141,638 | A | 10/2000 | Peng et al. |
| 6,449,313 | B1 | 9/2002 | Erzin et al. |
| 6,629,068 | B1 | 9/2003 | Horos et al. |
| 6,704,701 | B1 | 3/2004 | Gao |
| 6,766,289 | B2 | 7/2004 | Kandhadai et al. |

(Continued)

FOREIGN PATENT DOCUMENTS

| | | | |
|---|---|---|---|
| WO | 0223536 | A2 | 3/2002 |
| WO | 2012158157 | A1 | 11/2012 |

OTHER PUBLICATIONS

Geiser, B. et al., "Bandwidth Extension for Hierarchical Speech and Audio Coding in ITU-T Rec. G.729.1", IEEE Transactions on Audio, Speech and Language Processing, vol. 15, No. 8, 2007, pp. 2496-2509.

(Continued)

*Primary Examiner* — Qian Yang
(74) *Attorney, Agent, or Firm* — Toler Law Group, PC

(57) ABSTRACT

A method includes determining, at a speech encoder, first gain shape parameters based on a harmonically extended signal and/or based on a high-band residual signal associated with a high-band portion of an audio signal. The method also includes determining second gain shape parameters based on a synthesized high-band signal and based on the high-band portion of the audio signal. The method further includes inserting the first gain parameters and the second gain shape parameters into an encoded version of the audio signal to enable gain adjustment during reproduction of the audio signal from the encoded version of the audio signal.

30 Claims, 7 Drawing Sheets

(56) References Cited

U.S. PATENT DOCUMENTS

| | | | |
|---|---|---|---|
| 6,795,805 | B1 | 9/2004 | Bessette et al. |
| 7,117,146 | B2 | 10/2006 | Gao |
| 7,272,556 | B1 | 9/2007 | Aguilar et al. |
| 7,680,653 | B2 | 3/2010 | Yeldener |
| 7,788,091 | B2 | 8/2010 | Goudar et al. |
| 2002/0147583 | A1 | 10/2002 | Gao |
| 2003/0115042 | A1 | 6/2003 | Chen et al. |
| 2003/0128851 | A1 | 7/2003 | Furuta |
| 2004/0093205 | A1 | 5/2004 | Ashley et al. |
| 2005/0004793 | A1 | 1/2005 | Ojala et al. |
| 2006/0147127 | A1 | 7/2006 | Edler et al. |
| 2006/0173691 | A1 | 8/2006 | Mukaide |
| 2006/0282262 | A1 | 12/2006 | Vos et al. |
| 2008/0114605 | A1 | 5/2008 | Wu et al. |
| 2008/0208575 | A1 | 8/2008 | Laaksonen et al. |
| 2009/0254783 | A1 | 10/2009 | Hirschfeld et al. |
| 2010/0241433 | A1 | 9/2010 | Herre et al. |
| 2010/0332223 | A1 | 12/2010 | Morii et al. |
| 2011/0099004 | A1 | 4/2011 | Krishnan et al. |
| 2011/0295598 | A1 | 12/2011 | Yang et al. |
| 2012/0101824 | A1 | 4/2012 | Chen |
| 2012/0221326 | A1 | 8/2012 | Grancharov et al. |
| 2012/0300946 | A1 | 11/2012 | Ma |
| 2012/0323571 | A1 | 12/2012 | Song et al. |

OTHER PUBLICATIONS

Blamey, et al., "Formant-Based Processing for Hearing Aids", Speech Communication, vol. 13, Issues 3-4, Dec. 1993, pp. 453-461.

Boillot, et al., "A Loudness Enhancement Technique for Speech," IEEE, Proceedings of the 2004 International Symposium on Circuits and Systems, ISCAS 2004, vol. 5, May 2004, pp. V-616-V-619.

Cheveigne, "Formant Bandwidth Affects the Identification of Competing Vowels," CNRS—IRCAM, France, and ATR-HIP,1999, pp. 1-4.

Coelho, et al., "Voice Pleasantness: On the Improvement of TTS Voice Quality," Proc. V Jomadasen Tecnologia del Habla, Jan. 2008, Retrieved from download.microsoft.com/download/a/0/b/a0b1a66a-5ebf-4cf3-9453-4b13bb027f1f/jth08voicequality.pdf, pp. 1-6.

Cole, et al., "Speech Enhancement by Formant Sharpening in the Cepstral Domain," Proceedings of the 9th Australian International Conference on Speech Science & Technology, Australian Speech Science & Technology Association Inc., Melbourne, Australia, Dec. 3-5, 2002, pp. 244-249.

Cox, "Current Methods of Speech Coding," International Journal of High Speed Electronics and Systems, vol. 08, Issue 01, Mar. 1997, pp. 31-39.

ISO/IEC 14496-3:2005(E), Subpart 3: Speech Coding—CELP, 2005, pp. 1-165.

ITU-T, "Series G: Transmission Systems and Media, Digital Systems and Networks," Digital terminal equipments—Coding of analogue signals by methods other than PCM, Dual rate speech coder for multimedia communications transmitting at 5.3 and 6.3 kbit/s, G.723.1, ITU-T, May 2006, pp. 1.64.

Jokinen, et al., "Comparison of Post-Filtering Methods for Intelligibility Enhancement of Telephone Speech," Proceedings of the 20th European Signal Processing Conference (EUSIPCO 2012), Aug. 2012, pp. 2333-2337.

Taniguchi, et al., "Pitch Sharpeing for Perceptually Improved CELP, and the Sparse-Delta Codebook for Reduced Computation", Proceedings from the International Conference on Acoustics, Speech & Signal Processing, ICASSP, Apr. 1991, vol. 1, IEEE, pp. 241-244.

Zorila, et al., "Improving Speech Intelligibility in Noise Environments by Spectral Shaping and Dymanic Range Compression," The Listening Talker, vol. 88, 2012, 1 page.

Zorila, et al., "Improving Sppech Intelligibility in Noise Environments by Spectral Shaping and Dynamic Range Compression," Forth—Institute of Computer Science, Listening Talker, 2012, 1 page.

Zorila, et al., "Speech-In-Noise Intelligibility Improvement Based on Power Recovery and Dynamic Range Compression," 2012 Proceedings of the 20th European Signal Processing Conference (EUSIPCO 2012), Aug. 2012, IEEE, pp. 2075-2079.

International Search Report and Written Opinion—PCT/US2014/059753—ISA/EPO—Feb. 2, 2015, 12 pages.

GAIN SHAPE ESTIMATION FOR IMPROVED TRACKING OF HIGH-BAND TEMPORAL CHARACTERISTICS

I. CLAIM OF PRIORITY

The present application claims priority from U.S. Provisional Patent Application No. 61/889,434 entitled "GAIN SHAPE ESTIMATION FOR IMPROVED TRACKING OF HIGH-BAND TEMPORAL CHARACTERISTICS," filed Oct. 10, 2013, the contents of which are incorporated by reference in their entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 50 Hz to 7 kHz, also called the "low-band"). For example, the low-band may be represented using filter parameters and/or a low-band excitation signal. However, in order to improve coding efficiency, the higher frequency portion of the signal (e.g., 7 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc. Properties of the low-band signal may be used to generate the side information; however, energy disparities between the low-band and the high-band may result in side information that inaccurately characterizes the high-band.

IV. SUMMARY

Systems and methods for performing bi-stage gain shape estimation for improved tracking of high-band temporal characteristics are disclosed. A speech encoder may utilize a low-band portion (e.g., a harmonically extended low-band excitation) of an audio signal to generate information (e.g., side information) used to reconstruct a high-band portion of the audio signal at a decoder. A first gain shape estimator may determine energy variations in the high-band residual signal that are not present in the harmonically extended low-band excitation. For example, the gain shape estimator may estimate the temporal variations or deviations (e.g., energy levels) in the high-band that are shifted, or absent, in the high band residual signal relative to the harmonically extended low-band excitation signal. The first gain shape adjuster (based on the first gain shape parameters) may adjust the temporal evolution of the harmonically extended low-band excitation such that it closely mimics the temporal envelope of the high band residual. A synthesized high-band signal may be generated based on the adjusted/modified harmonically extended low-band excitation, and a second gain shape estimator may determine energy variations between the synthesized high-band signal and the high-band portion of the audio signal at a second stage. The synthesized high-band signal may be adjusted to model the high-band portion of the audio signal based on data (e.g., second gain shape parameters) from the second gain shape estimator. The first gain shape parameters and the second gain shape parameters may be transmitted to the decoder along with other side information to reconstruct the high-band portion of the audio signal.

In a particular aspect, a method includes determining, at a speech encoder, first gain shape parameters based on a harmonically extended signal and/or based on a high-band residual signal associated with a high-band portion of an audio signal. In another particular aspect, the first gain shape parameters are determined based on the temporal evolution in the high-band residual signal associated with a high-band portion of an audio signal. The method also includes determining second gain shape parameters based on a synthesized high-band signal and based on the high-band portion of the audio signal. The method further includes inserting the first gain shape parameters and the second gain shape parameters into an encoded version of the audio signal to enable gain adjustment during reproduction of the audio signal from the encoded version of the audio signal.

In another particular aspect, an apparatus includes a first gain shape estimator configured to determine first gain shape parameters based on a harmonically extended signal and/or based on a high-band residual signal associated with a high-band portion of an audio signal. The apparatus also includes a second gain shape estimator configured to determine second gain shape parameters based on a synthesized high-band signal and based on the high-band portion of the audio signal. The apparatus further includes a multiplexer configured to insert the first gain shape parameters and the second gain shape parameters into an encoded version of the audio signal to enable gain adjustment during reproduction of the audio signal from the encoded version of the audio signal.

In another particular aspect, a non-transitory computer readable medium includes instructions that, when executed by a processor, cause the processor to determine first gain shape parameters based on a harmonically extended signal and/or based on a high-band residual signal associated with a high-band portion of an audio signal. The instructions are also executable to cause the processor to determine second gain shape parameters based on a synthesized high-band signal and based on the high-band portion of the audio signal. The instructions are also executable to cause the processor to insert the first gain shape parameters and the second gain shape parameters into an encoded version of the audio signal to enable gain adjustment during reproduction of the audio signal from the encoded version of the audio signal.

In another particular aspect, an apparatus includes means for determining first gain shape parameters based on a harmonically extended signal and/or based on a high-band residual signal associated with a high-band portion of an audio signal. The apparatus also includes means for determining second gain shape parameters based on a synthesized high-band signal and based on the high-band portion of the audio signal. The apparatus also includes means for inserting the first gain shape parameters and the second gain shape parameters into an encoded version of the audio signal to enable gain adjustment during reproduction of the audio signal from the encoded version of the audio signal.

In another particular aspect, a method includes receiving, at a speech decoder, an encoded audio signal from a speech encoder. The encoded audio signal includes first gain shape parameters based on a first harmonically extended signal generated at the speech encoder and/or based on a high-band residual signal generated at the speech encoder. The encoded audio signal also includes second gain shape parameters based on a first synthesized high-band signal generated at the speech encoder and based on a high-band of an audio signal. The method also includes reproducing the audio signal from the encoded audio signal based on the first gain shape parameters and based on the second gain shape parameters.

In another particular aspect, a speech decoder is configured to receive an encoded audio signal from a speech encoder. The encoded audio signal includes first gain shape parameters based on a harmonically extended signal generated at the speech encoder and/or based on a high-band residual signal generated at the speech encoder. The encoded audio signal also includes second gain shape parameters based on a first synthesized high-band signal generated at the speech encoder and based on a high-band of an audio signal. The speech decoder is further configured to reproduce the audio signal from the encoded audio signal based on the first gain shape parameters and based on the second gain shape parameters.

In another particular aspect, an apparatus includes means for receiving an encoded audio signal from a speech encoder. The encoded audio signal includes first gain shape parameters based on a first harmonically extended signal generated at the speech encoder and/or based on a high-band residual signal generated at the speech encoder. The encoded audio signal also includes second gain shape parameters based on a first synthesized high-band signal generated at the speech encoder and based on a high-band of an audio signal. The apparatus also includes means for reproducing the audio signal from the encoded audio signal based on the first gain shape parameters and based on the second gain shape parameters.

In another particular aspect, a non-transitory computer readable medium includes instructions that, when executed by a processor, cause the processor to receive an encoded audio signal from a speech encoder. The encoded audio signal includes first gain shape parameters based on a first harmonically extended signal generated at the speech encoder and/or based on a high-band residual signal generated at the speech encoder. The encoded audio signal also includes second gain shape parameters based on a first synthesized high-band signal generated at the speech encoder and based on a high-band of an audio signal. The instructions are also executable to cause the processor to reproduce the audio signal from the encoded audio signal based on the first gain shape parameters and based on the second gain shape parameters.

Particular advantages provided by at least one of the disclosed embodiments include improving energy correlation between a harmonically extended low-band excitation of an audio signal and a high-band residual of the audio signal. For example, the harmonically extended low-band excitation may be adjusted based on gain shape parameters to closely mimic the temporal characteristics of the high band residual signal. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
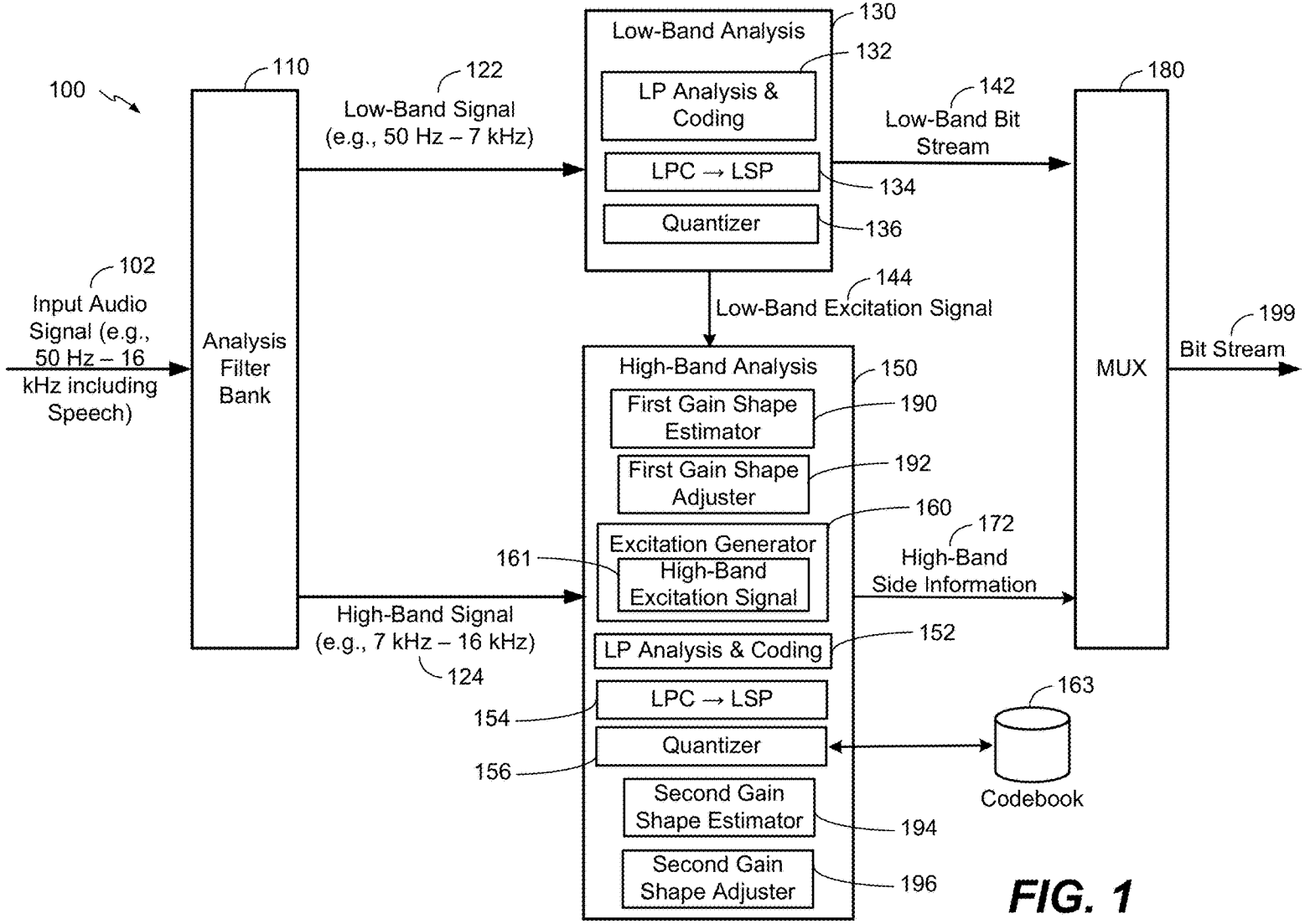
FIG. 1 is a diagram to illustrate a particular embodiment of a system that is operable to determine gain shape parameters at two stages for high-band reconstruction.

Referring to FIG. 1, a Particular Embodiment of a System that is Operable to determine gain shape parameters at two stages for high-band reconstruction is shown and generally designated 100. In a particular embodiment, the system 100 may be integrated into an encoding system or apparatus (e.g., in a wireless telephone, a coder/decoder (CODEC), or a digital signal processor (DSP)). In other particular embodiments, the system 100 may be integrated into a set top box, a music player, a video player, an entertainment unit, a navigation device, a communications device, a PDA, a fixed location data unit, or a computer.

It should be noted that in the following description, various functions performed by the system 100 of FIG. 1 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a DSP, a controller, etc.), software (e.g., instructions executable by a processor), or any combination thereof.

The system 100 includes an analysis filter bank 110 that is configured to receive an input audio signal 102. For example, the input audio signal 102 may be provided by a microphone or other input device. In a particular embodiment, the input audio signal 102 may include speech. The input audio signal 102 may be a SWB signal that includes data in the frequency range from approximately 50 Hz to approximately 16 kHz. The analysis filter bank 110 may filter the input audio signal 102 into multiple portions based on frequency. For example, the analysis filter bank 110 may generate a low-band signal 122 and a high-band signal 124. The low-band signal 122 and the high-band signal 124 may have equal or unequal bandwidth, and may be overlapping or non-overlapping. In an alternate embodiment, the analysis filter bank 110 may generate more than two outputs.

In the example of FIG. 1, the low-band signal 122 and the high-band signal 124 occupy non-overlapping frequency bands. For example, the low-band signal 122 and the high-band signal 124 may occupy non-overlapping frequency bands of 50 Hz-7 kHz and 7 kHz-16 kHz, respectively. In an alternate embodiment, the low-band signal 122 and the high-band signal 124 may occupy non-overlapping frequency bands of 50 Hz-8 kHz and 8 kHz-16 kHz, respectively. In an another alternate embodiment, the low-band signal 122 and the high-band signal 124 overlap (e.g., 50 Hz-8 kHz and 7 kHz-16 kHz, respectively), which may enable a low-pass filter and a high-pass filter of the analysis filter bank 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

It should be noted that although the example of FIG. 1 illustrates processing of a SWB signal, this is for illustration only. In an alternate embodiment, the input audio signal 102 may be a WB signal having a frequency range of approximately 50 Hz to approximately 8 kHz. In such an embodiment, the low-band signal 122 may, for example, correspond to a frequency range of approximately 50 Hz to approximately 6.4 kHz and the high-band signal 124 may correspond to a frequency range of approximately 6.4 kHz to approximately 8 kHz.

The system 100 may include a low-band analysis module 130 configured to receive the low-band signal 122. In a particular embodiment, the low-band analysis module 130 may represent an embodiment of a code excited linear prediction (CELP) encoder. The low-band analysis module 130 may include a linear prediction (LP) analysis and coding module 132, a linear prediction coefficient (LPC) to LSP transform module 134, and a quantizer 136. LSPs may also be referred to as LSFs, and the two terms (LSP and LSF) may be used interchangeably herein. The LP analysis and coding module 132 may encode a spectral envelope of the low-band signal 122 as a set of LPCs. LPCs may be generated for each frame of audio (e.g., 20 milliseconds (ms) of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. In a particular embodiment, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error.

The system 100 may further include a high-band analysis module 150 configured to receive the high-band signal 124 from the analysis filter bank 110 and the low-band excitation signal 144 from the low-band analysis module 130. The high-band analysis module 150 may generate high-band side information 172 based on the high-band signal 124 and the low-band excitation signal 144. For example, the high-band side information 172 may include high-band LSPs and/or gain information (e.g., based on at least a ratio of high-band energy to low-band energy), as further described herein. In a particular embodiment, the gain information may include gain shape parameters based on a harmonically extended signal and/or a high-band residual signal. The harmonically extended signal may be inadequate for use in high-band synthesis due to insufficient correlation between the high-band signal 124 and the low-band signal 122. For example, sub-frames of the high-band signal 124 may include fluctuations in energy levels that are not adequately mimicked in the modeled high-band excitation signal 161.

The high-band analysis module 150 may include a first gain shape estimator 190. The first gain shape estimator 190 may determine first gain shape parameters based on a first signal associated with the low-band signal 122 and/or based on a high-band residual of the high-band signal 124. As described herein, the first signal may be a transformed (e.g., non-linear or harmonically extended) low-band excitation of the low-band signal 122. The high-band side information 172 may include the first gain shape parameters. The high-band analysis module 150 may also include a first gain shape adjuster 192 configured to adjust the harmonically extended low-band excitation based on the first gain shape parameters. For example, the first gain shape adjuster 192 may scale particular sub-frames of the harmonically extended low-band excitation to approximate energy levels of corresponding sub-frames of the residual of the high-band signal 124.

The high-band analysis module 150 may also include a high-band excitation generator 160. The high-band excitation generator 160 may generate a high-band excitation signal 161 by extending a spectrum of the low-band excitation signal 144 into the high-band frequency range (e.g., 7 kHz-16 kHz). To illustrate, the high-band excitation generator 160 may mix the adjusted harmonically extended low-band excitation with a noise signal (e.g., white noise modulated according to an envelope corresponding to the low-band excitation signal 144 that mimics slow varying temporal characteristics of the low-band signal 122) to generate the high-band excitation signal 161. For example, the mixing may be performed according to the following equation:

$$\text{High-band excitation}=(\alpha*\text{adjusted harmonically extended low-band excitation})+((1-\alpha)*\text{modulated noise})$$

The ratio at which the adjusted harmonically extended low-band excitation and the modulated noise are mixed may impact high-band reconstruction quality at a receiver. For voiced speech signals, the mixing may be biased towards the adjusted harmonically extended low-band excitation (e.g., the mixing factor $\alpha$ may be in the range of 0.5 to 1.0). For unvoiced signals, the mixing may be biased towards the modulated noise (e.g., the mixing factor $\alpha$ may be in the range of 0.0 to 0.5).

As illustrated, the high-band analysis module 150 may also include an LP analysis and coding module 152, a LPC to LSP transform module 154, and a quantizer 156. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). The LP analysis and coding module 152 may generate a set of LPCs that are transformed to LSPs by the transform module 154 and quantized by the quantizer 156 based on a codebook 163. For example, the LP analysis and coding module 152, the transform module 154, and the quantizer 156 may use the high-band signal 124 to determine high-band filter information (e.g., high-band LSPs) that is included in the high-band side information 172.

The quantizer 156 may be configured to quantize a set of spectral frequency values, such as LSPs provided by the transform module 154. In other embodiments, the quantizer 156 may receive and quantize sets of one or more other types of spectral frequency values in addition to, or instead of, LSFs or LSPs. For example, the quantizer 156 may receive and quantize a set of LPCs generated by the LP analysis and coding module 152. Other examples include sets of parcor coefficients, log-area-ratio values, and ISFs that may be received and quantized at the quantizer 156. The quantizer 156 may include a vector quantizer that encodes an input vector (e.g., a set of spectral frequency values in a vector format) as an index to a corresponding entry in a table or codebook, such as the codebook 163. As another example, the quantizer 156 may be configured to determine one or more parameters from which the input vector may be generated dynamically at a decoder, such as in a sparse codebook embodiment, rather than retrieved from storage. To illustrate, sparse codebook examples may be applied in coding schemes such as CELP and codecs according to industry standards such as 3GPP2 (Third Generation Partnership 2) EVRC (Enhanced Variable Rate Codec). In another embodiment, the high-band analysis module 150 may include the quantizer 156 and may be configured to use a number of codebook vectors to generate synthesized signals (e.g., according to a set of filter parameters) and to select one of the codebook vectors associated with the synthesized signal that best matches the high-band signal 124, such as in a perceptually weighted domain.

In a particular embodiment, the high-band side information 172 may include high-band LSPs as well as high-band gain parameters. For example, the high-band excitation signal 161 may be used to determine additional gain parameters that are included in the high-band side information 172. The high-band analysis module 150 may include a second gain shape estimator 194 and a second gain shape adjuster 196. A linear prediction coefficient synthesis operation may be performed on the high-band excitation signal 161 to generate a synthesized high-band signal. The second gain shape estimator 194 may determine second gain shape parameters based on the synthesized high band signal and the high-band signal 124. The high-band side information 172 may include the second gain shape parameters. The second gain shape adjuster 196 may be configured to adjust the synthesized high-band signal based on the second gain shape parameters. For example, the second gain shape adjuster 196 may scale particular sub-frames of the synthesized high-band signal to approximate energy levels of corresponding sub-frames of the high-band signal 124.

The low-band bit stream 142 and the high-band side information 172 may be multiplexed by a multiplexer (MUX) 180 to generate an output bit stream 199. The output bit stream 199 may represent an encoded audio signal corresponding to the input audio signal 102. For example, the output bit stream 199 may be transmitted (e.g., over a wired, wireless, or optical channel) and/or stored. Thus, the multiplexer 180 may insert the first gain shape parameters determined by the first gain shape estimator 190 and the second gain shape parameters determined by the second gain shape estimator 194 into the output bit stream 199 to enable high-band excitation gain adjustment during reproduction of the input audio signal 102. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 199 may represent low-band data. The high-band side information 172 may be used at a receiver to regenerate the high-band excitation signal from the low-band data in accordance with a signal model. For example, the signal model may represent an expected set of relationships or correlations between low-band data (e.g., the low-band signal 122) and high-band data (e.g., the high-band signal 124). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band signal 124 from the output bit stream 199.

The system 100 may improve a frame-by-frame energy correlation (e.g., improve a temporal evolution) between a harmonically extended low-band excitation of the audio signal 102 and a high-band residual of the input audio signal 102. For example, during a first gain stage, the first gain shape estimator 190 and the first gain shape adjuster 192 may adjust the harmonically extended low-band excitation based on first gain parameters. The harmonically extended low-band excitation may be adjusted to approximate the residual of the high-band on a frame-by-frame basis. Adjusting the harmonically extended low-band excitation may improve gain shape estimation in the synthesis domain and reduce audible artifacts during high-band reconstruction of the input audio signal 102. The system 100 may also improve a frame-by-frame energy correlation between the high-band signal 124 and a synthesized version of the high-band signal 124. For example, during a second gain stage, the second gain shape estimator 194 and the second gain shape adjuster 196 may adjust the synthesized version of the high-band signal 124 based on second gain parameters. The synthesized version of the high-band signal 124 may be adjusted to approximate the high-band signal 124 on a frame-by-frame basis. The first and second gain shape parameters may be transmitted to a decoder to reduce audible artifacts during high-band reconstruction of the input audio signal 102.

Figure 2:
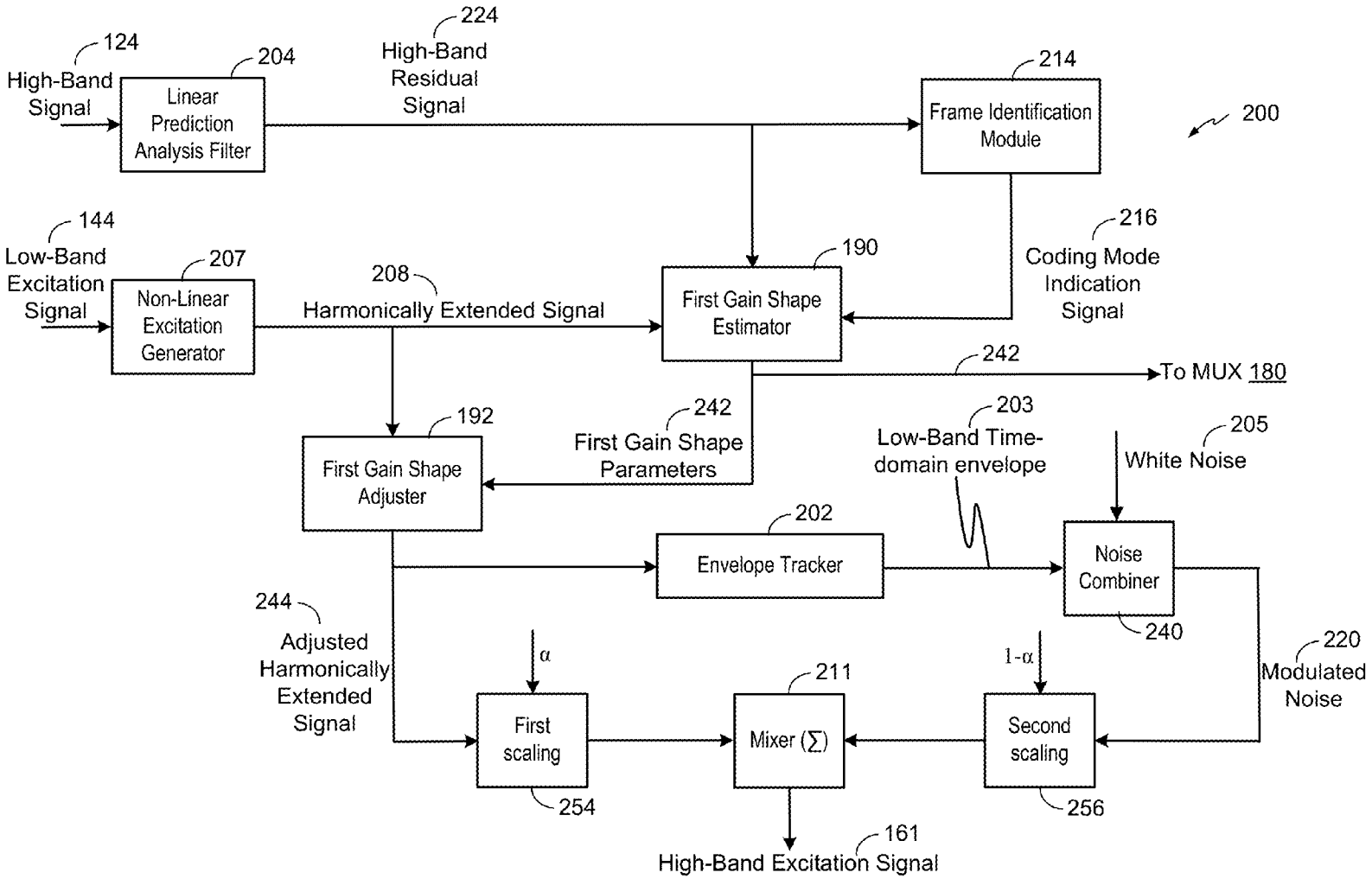
FIG. 2 is a diagram to illustrate a particular embodiment of a system that is operable to determine gain shape parameters at a first stage based on a harmonically extended signal and/or a high-band residual signal.

Referring to FIG. 2, a particular embodiment of a system 200 that is operable to determine gain shape parameters at a first stage based on a harmonically extended signal and/or a high-band residual signal is shown. The system 200 includes a linear prediction analysis filter 204, a non-linear excitation generator 207, a frame identification module 214, the first gain shape estimator 190, and the first gain shape adjuster 192.

The high-band signal 124 may be provided to the linear prediction analysis filter 204. The linear prediction analysis filter 204 may be configured to generate a high-band residual signal 224 based on the high-band signal 124 (e.g., a high-band portion of the input audio signal 102). For example, the linear prediction analysis filter 204 may encode a spectral envelope of the high-band signal 124 as a set of the LPCs used to predict future samples (based on the current samples) of the high-band signal 124. The high-band residual signal 224 may be provided to the frame identification module 214 and to the first gain shape estimator 190.

The frame identification module 214 may be configured to determine a coding mode for a particular frame of the high-band residual signal 224 and to generate a coding mode indication signal 216 based on the coding mode. For example, the frame identification module 214 may determine whether the particular frame of the high-band residual signal 224 is a voiced frame or an un-voiced frame. In a particular embodiment, a voiced frame may correspond to a first coding mode (e.g., a first metric) and an unvoiced frame may correspond to a second coding mode (e.g., a second metric).

The low-band excitation signal 144 may be provided to the non-linear excitation generator 207. As described with respect to FIG. 1, the low-band excitation signal 144 may be generated from the low-band signal 122 (e.g., the low-band portion of the input audio signal 102) using the low-band analysis module 130. The non-linear excitation generator 207 may be configured to generate a harmonically extended signal 208 based on the low-band excitation signal 144. For example, the non-linear excitation generator 207 may perform an absolute-value operation or a square operation on frames (or sub-frames) of the low-band excitation signal 144 to generate the harmonically extended signal 208.

To illustrate, the non-linear excitation generator 207 may up-sample the low-band excitation signal 144 (e.g., a signal ranging from approximately 0 kHz to 8 kHz) to generate a 16 kHz signal ranging from approximately 0 kHz to 16 kHz (e.g., a signal having approximately twice the bandwidth of the low-band excitation signal 144) and subsequently performing a non-linear operation on the up-sampled signal. A low-band portion of the 16 kHz signal (e.g., approximately from 0 kHz to 8 kHz) may have substantially similar harmonics as the low-band excitation signal 144, and a high-band portion of the 16 kHz signal (e.g., approximately from 8 kHz to 16 kHz) may be substantially free of harmonics. The non-linear excitation generator 207 may extend the "dominant" harmonics in the low-band portion of the 16 kHz signal to the high-band portion of the 16 kHz signal to generate the harmonically extended signal 208. Thus, the harmonically extended signal 208 may be a harmonically extended version of the low-band excitation signal 144 that extends harmonics into the high-band using non-linear operations (e.g., square operations and/or absolute value operations). The harmonically extended signal 208 may be provided to the first gain shape estimator 190 and to the first gain shape adjuster 192.

The first gain shape estimator 190 may receive the coding mode indication signal 216 and determine a sampling rate based on the coding mode. For example, the first gain shape estimator 190 may sample a first frame of the harmonically extended signal 208 to generate a first plurality of sub-frames and may sample a second frame of the high-band residual signal 224 at similar time instances to generate a second plurality of sub-frames. The number of sub-frames (e.g., vector dimensions) in the first and second plurality of sub-frames may be based on the coding mode. For example, the first (and second) plurality of sub-frames may include a first number of sub-frames in response to a determination that the coding mode indicates that the particular frame of the high-band residual signal 224 is a voiced frame. In a particular embodiment, the first and second plurality of sub-frames may each include sixteen sub-frames in response to a determination that the particular frame of the high-band residual signal 224 is a voiced frame. Alternatively, the first (and second) plurality of sub-frames may include a second number of sub-frames that is less than the first number of sub-frames in response to a determination that the coding mode indicates that the particular frame of the high-band residual signal 224 is not a voiced frame. For example, the first and second plurality of sub-frames may each include eight sub-frames in response to a determination that the coding mode indicates that the particular frame of the high-band residual signal 224 is not a voiced frame.

The first gain shape estimator 190 may be configured to determine first gain shape parameters 242 based on the harmonically extended signal 208 and/or the high-band residual signal 224. The first gain shape estimator 190 may evaluate energy levels of each sub-frame of the first plurality of sub-frames and evaluate energy levels of each corresponding sub-frame of the second plurality of sub-frames. For example, the first gain shape parameters 242 may identify particular sub-frames of the harmonically extended signal 208 that have lower or higher energy levels than corresponding sub-frames of the high-band residual signal 224. The first gain shape estimator 190 may also determine an amount of scaling of energy to provide to each particular sub-frame of the harmonically extended signal 208 based on the coding mode. The scaling of energy may be performed at a sub-frame level of the harmonically extended signal 208 having a lower or higher energy level compared to corresponding sub-frames of the high-band residual signal 224. For example, in response to a determination that the coding mode has a first metric (e.g., a voiced frame), a particular sub-frame of the harmonically extended signal 208 may be scaled by a factor of $(\Sigma R_{HB}^2)/(\Sigma R'_{LB}^2)$, where $(\Sigma R'_{LB}^2)$ corresponds to an energy level of the particular sub-frame of the harmonically extended signal 208 and ($\Sigma R_{HB}^2$) corresponds to an energy level of a corresponding sub-frame of the high-band residual signal 224. Alternatively, in response to a determination that the coding mode has a second metric (e.g., an unvoiced frame), the particular sub-frame of the harmonically extended signal 208 may be scaled by a factor of $\Sigma[(R_{HB})*(R'_{LB})]/(\Sigma R'^2_{LB})$. The first gain shape parameters 242 may identify each sub-frame of the harmonically extended signal 208 that requires an energy scaling and may identify the calculated energy scaling factor for the respective sub-frames. The first gain shape parameters 242 may be provided to the first gain shape adjuster 192 and to the multiplexer 180 of FIG. 1 as high-band side information 172.

The first gain shape adjuster 192 may be configured to adjust the harmonically extended signal 208 based on the first gain shape parameters 242 to generate an adjusted harmonically extended signal 244. For example, the first gain shape adjuster 192 may scale the identified sub-frames of the harmonically extended signal 208 according to the calculated energy scaling to generate the adjusted harmonically extended signal 244. The adjusted harmonically extended signal 244 may be provided to an envelope tracker 202 and to a first combiner 254 to perform a scaling operation.

The envelope tracker 202 may be configured to receive the adjusted harmonically extended signal 244 and to calculate a low-band time-domain envelope 203 corresponding to the adjusted harmonically extended signal 244. For example, the envelope tracker 202 may be configured to calculate the square of each sample of a frame of the adjusted harmonically extended signal 244 to produce a sequence of squared values. The envelope tracker 202 may be configured to perform a smoothing operation on the sequence of squared values, such as by applying a first order infinite impulse response (IIR) low-pass filter to the sequence of squared values. The envelope tracker 202 may be configured to apply a square root function to each sample of the smoothed sequence to produce the low-band time-domain envelope 203. The envelope tracker 202 may also use an absolute operation instead of a square operation. The low-band time-domain envelope 203 may be provided to a noise combiner 240.

The noise combiner 240 may be configured to combine the low-band time-domain envelope 203 with white noise 205 generated by a white noise generator (not shown) to produce a modulated noise signal 220. For example, the noise combiner 240 may be configured to amplitude-modulate the white noise 205 according to the low-band time-domain envelope 203. In a particular embodiment, the noise combiner 240 may be implemented as a multiplier that is configured to scale the white noise 205 according to the low-band time-domain envelope 203 to produce the modulated noise signal 220. The modulated noise signal 220 may be provided to a second combiner 256.

The first combiner 254 may be implemented as a multiplier that is configured to scale the adjusted harmonically extended signal 244 according to the mixing factor (a) to generate a first scaled signal. The second combiner 256 may be implemented as a multiplier that is configured to scale the modulated noise signal 220 based on the mixing factor ($1-\alpha$) to generate a second scaled signal. For example, the second combiner 256 may scale the modulated noise signal 220 based on the difference of one minus the mixing factor (e.g., $1-\alpha$). The first scaled signal and the second scaled signal may be provided to the mixer 211.

The mixer 211 may generate the high-band excitation signal 161 based on the mixing factor ($\alpha$), the adjusted harmonically extended signal 244, and the modulated noise signal 220. For example, the mixer 211 may combine the first scaled signal and the second scaled signal to generate the high-band excitation signal 161.

The system 200 of FIG. 2 may improve a temporal evolution of energy between the harmonically extended signal 208 and the high-band residual signal 224. For example, the first gain shape estimator 190 and the first gain shape adjuster 192 may adjust the harmonically extended signal 208 based on first gain shape parameters 242. The harmonically extended signal 208 may be adjusted to approximate energy levels of the high-band residual signal 224 on a sub-frame-by-sub-frame basis. Adjusting the harmonically extended signal 208 may reduce audible artifacts in the synthesis domain as described with respect to FIG. 4. The system 200 may also dynamically adjust the number of sub-frames based on the coding mode to modify the gain shape parameters 242 based on pitch variances. For example, a relatively small number of gain shape parameters 242 (e.g., a relatively small number of sub-frames) may be generated for an unvoiced frame having a relatively low variance in temporal evolution within the frame. Alternatively, a relatively large number of gain shape parameters 242 may be generated for a voiced frame having a relatively high variance in temporal evolution within a frame. In an alternate embodiment, the number of sub-frames selected to adjust the temporal evolution of the harmonically extended low band may be the same for both an unvoiced frame as well as a voiced frame.

Figure 3:
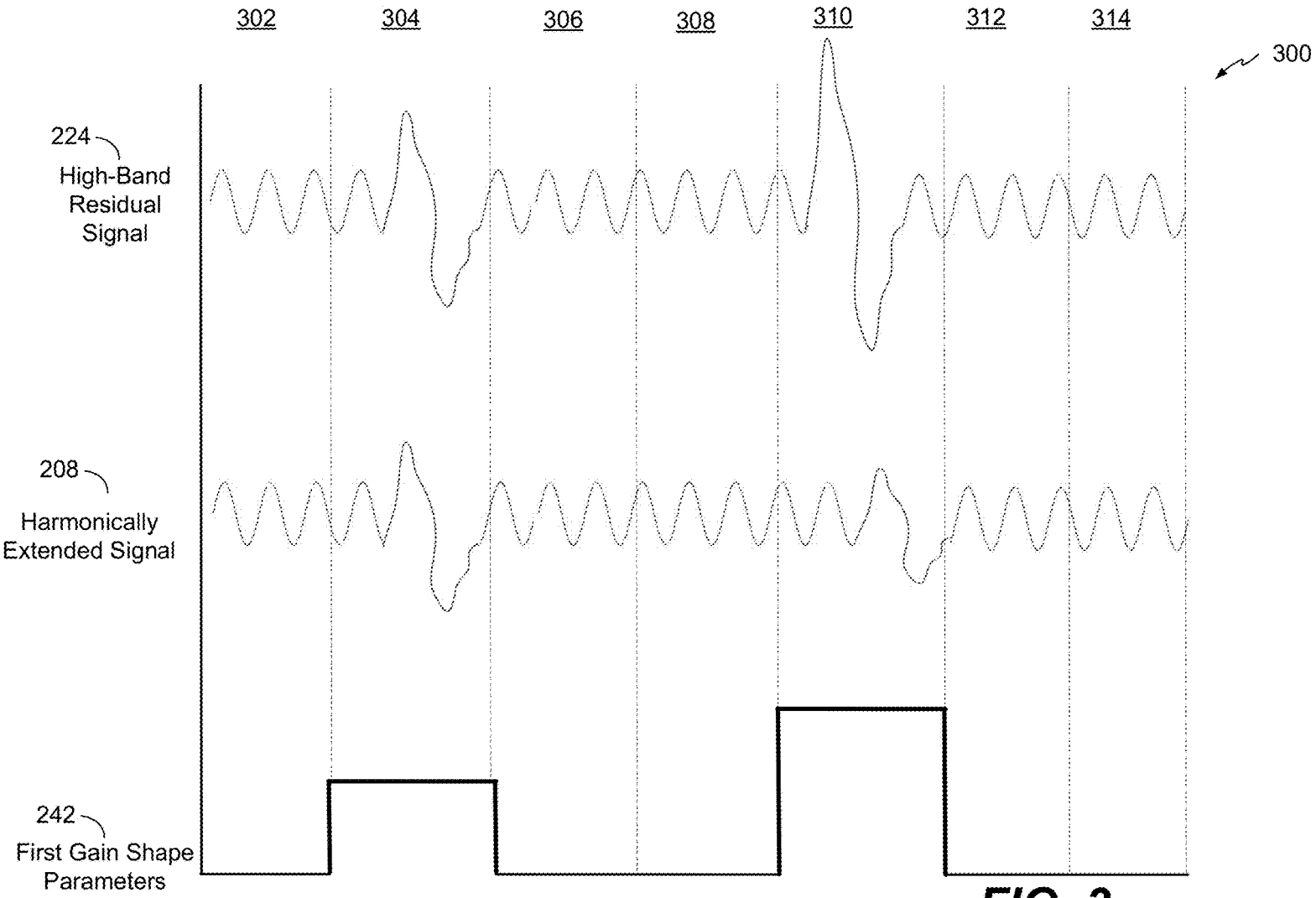
FIG. 3 is a timing diagram to illustrate gain shape parameters based on energy disparities between the harmonically extended signal and the high-band residual signal.

Referring to FIG. 3, a timing diagram 300 to illustrate gain shape parameters based on energy disparities between a harmonically extended signal and a high-band residual signal is shown. The timing diagram 300 includes a first trace of the high-band residual signal 224, a second trace of the harmonically extended signal 208, and a third trace of estimated gain shape parameters 242.

The timing diagram 300 depicts a particular frame of the high-band residual signal 224 and a corresponding frame of the harmonically extended signal 208. The timing diagram 300 includes a first timing window 302, a second timing window 304, a third timing window 306, a fourth timing window 308, a fifth timing window 310, a sixth timing window 312, and a seventh timing window 314. Each timing window 302-314 may represent a sub-frame of the respective signals 224, 208. Although seven timing windows are depicted, in other embodiments, additional (or fewer) timing windows may be present. For example, in a particular embodiment, each respective signal 224, 208 may include as low as four timing windows or as high as sixteen timing windows (i.e., four sub-frames or sixteen sub-frames). The number of timing windows may be based on the coding mode as described with respect to FIG. 2.

The energy level of the high-band residual signal 224 in the first timing window 302 may approximate the energy level of the corresponding harmonically extended signal 208 in the first timing window 302. For example, the first gain shape estimator 190 may measure the energy level of the high-band residual signal 224 in the first timing window 302, measure the energy level of the harmonically extended signal 208 in the first timing window 302, and compare a difference to a threshold. The energy level of the high-band residual signal 224 may approximate the energy level of the harmonically extended signal 208 if the difference is below the threshold. Thus in this case, the first gain shape parameter 242 for the first timing window 302 may indicate that an energy scaling is not needed for the corresponding sub-frames of the harmonically extended signal 208. The energy levels of the high-band residual signal 224 for the third, and fourth timing windows 306, 308 may also approximate the energy level of the corresponding harmonically extended signal 208 in the third, and fourth timing windows 306, 308. Thus, the first gain shape parameters 242 for the third, and fourth timing windows 306, 308 may also indicate that an energy scaling may not needed for the corresponding sub-frames of the harmonically extended signal 208.

The energy level of the high-band residual signal 224 in the second and fifth timing window 304, 310 may fluctuate and the corresponding energy level of the harmonically extended signal 208 in the second and fifth timing window 304, 310 may not accurately reflect the fluctuation in the high-band residual signal 224. The first gain shape estimator 190 of FIGS. 1-2 may generate the gain shape parameter 242 in the second and fifth timing window 304, 310 to adjust the harmonically extended signal 208. For example, the first gain shape estimator 190 may indicate to the first gain shape adjuster 192 to "scale" the harmonically extended signal 208 at the second and fifth timing window 304, 310 (e.g., the second and the fifth sub-frame). The amount that the harmonically extended signal 208 is adjusted may be based on the coding mode of the high-band residual signal 224. For example, the harmonically extended signal 208 may be adjusted by a factor of $(\Sigma R_{HB}^2)/(\Sigma R'^2_{LB})$ if the coding mode indicates that the frame is a voiced frame. Alternatively, the harmonically extended signal 208 may be adjusted by a factor of $\Sigma[(R_{HB})*(R'_{LB})]/(\Sigma R'^2_{LB})$ if the coding mode indicates that the frame is an unvoiced frame.

The energy level of the high-band residual signal 224 for the sixth and seventh timing windows 312, 314 may approximate the energy level of the corresponding harmonically extended signal 208 in the sixth and seventh timing windows 312, 314. Thus, the first gain shape parameters 242 for the sixth and seventh timing windows 312, 314 may indicate that an energy scaling is not needed to the corresponding sub-frames of the harmonically extended signal 208.

Generating first gain shape parameters 242 as described with respect to FIG. 3 may improve a temporal evolution of energy between the harmonically extended signal 208 and the high-band residual signal 224. For example, energy fluctuations in the high-band residual signal 224 may be accounted for in the harmonically extended signal 208 by adjusting it based on the first gain shape parameters 242. Adjusting the harmonically extended signal 208 may reduce audible artifacts in the synthesis domain as described with respect to FIG. 4.

Figure 4:
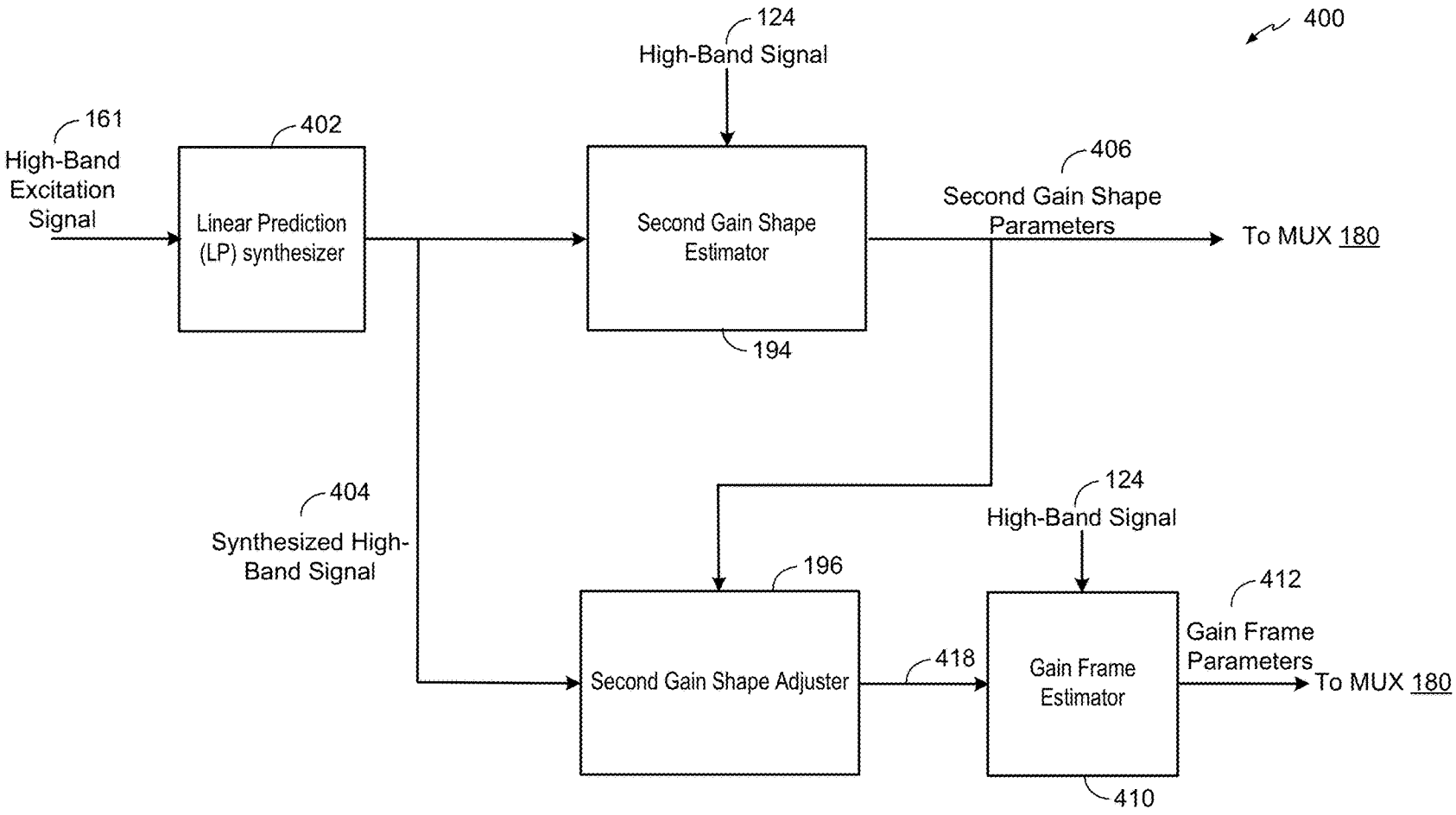
FIG. 4 is a diagram to illustrate a particular embodiment of a system that is operable to determine second gain shape parameters at a second stage based on a synthesized high-band signal and a high-band portion of an input audio signal.

Referring to FIG. 4, a particular embodiment of a system 400 that is operable to determine second gain shape parameters at a second stage based on a synthesized high-band signal and a high-band portion of an input audio signal is shown. The system 400 may include a linear prediction (LP) synthesizer 402, the second gain shape estimator 194, the second gain shape adjuster 196, and a gain frame estimator 410.

The linear prediction (LP) synthesizer 402 may be configured to receive the high-band excitation signal 161 and to perform a linear prediction synthesis operation on the high-band excitation signal 161 to generate a synthesized high-band signal 404. The synthesized high-band signal 404 may be provided to the second gain shape estimator 194 and to the second gain shape adjuster 196.

The second gain shape estimator 194 may be configured to determine second gain shape parameters 406 based on the synthesized high-band signal 404 and the high-band signal 124. For example, the second gain shape estimator 194 may evaluate energy levels of each sub-frame of the synthesized high-band signal 404 and evaluate energy levels of each corresponding sub-frame of the high-band signal 124. For example, the second gain shape parameters 406 may identify particular sub-frames of the synthesized high-band signal 404 that have lower energy levels than corresponding sub-frames of the high-band signal 124. The second gain shape parameters 406 may be determined in a synthesis domain. For example, the second gain shape parameters 406 may be determined using a synthesized signal (e.g., the synthesized high-band signal 404) as opposed to an excitation signal (e.g., the harmonically extended signal 208) in an excitation domain. The second gain shape parameters 406 may be provided to the second gain shape adjuster 196 and to the multiplexer 180 as high-band side information 172.

The second gain shape adjuster 196 may be configured to generate an adjusted synthesized high-band signal 418 based on the second gain shape parameters 406. For example, the second gain shape adjuster 196 may "scale" particular sub-frames of the synthesized high-band signal 404 based on the second gain shape parameters 406 to generate the adjusted synthesized high-band signal 418. The second gain shape adjuster 196 may "scale" sub-frames of the synthesized high-band signal 404 in a similar manner as the first gain shape adjuster 192 of FIGS. 1-2 adjusts particular sub-frames of the harmonically extended signal 208 based on the first gain shape parameters 242. The adjusted synthesized high-band signal 418 may be provided to the gain frame estimator 410.

The gain frame estimator 410 may generate gain frame parameters 412 based on the adjusted synthesized high-band signal 404 and the high-band signal 124. The gain frame parameters 412 may be provided to the multiplexer 180 as high-band side information 172.

The system 400 of FIG. 4 may improve high-band reconstruction of the input audio signal 102 of FIG. 1 by generating second gain shape parameters 406 based on energy levels of the synthesized high-band signal 404 and corresponding energy levels of the high-band signal 124. The second gain shape parameters 406 may reduce audible artifacts during high-band reconstruction of the input audio signal 102.

Figure 5:
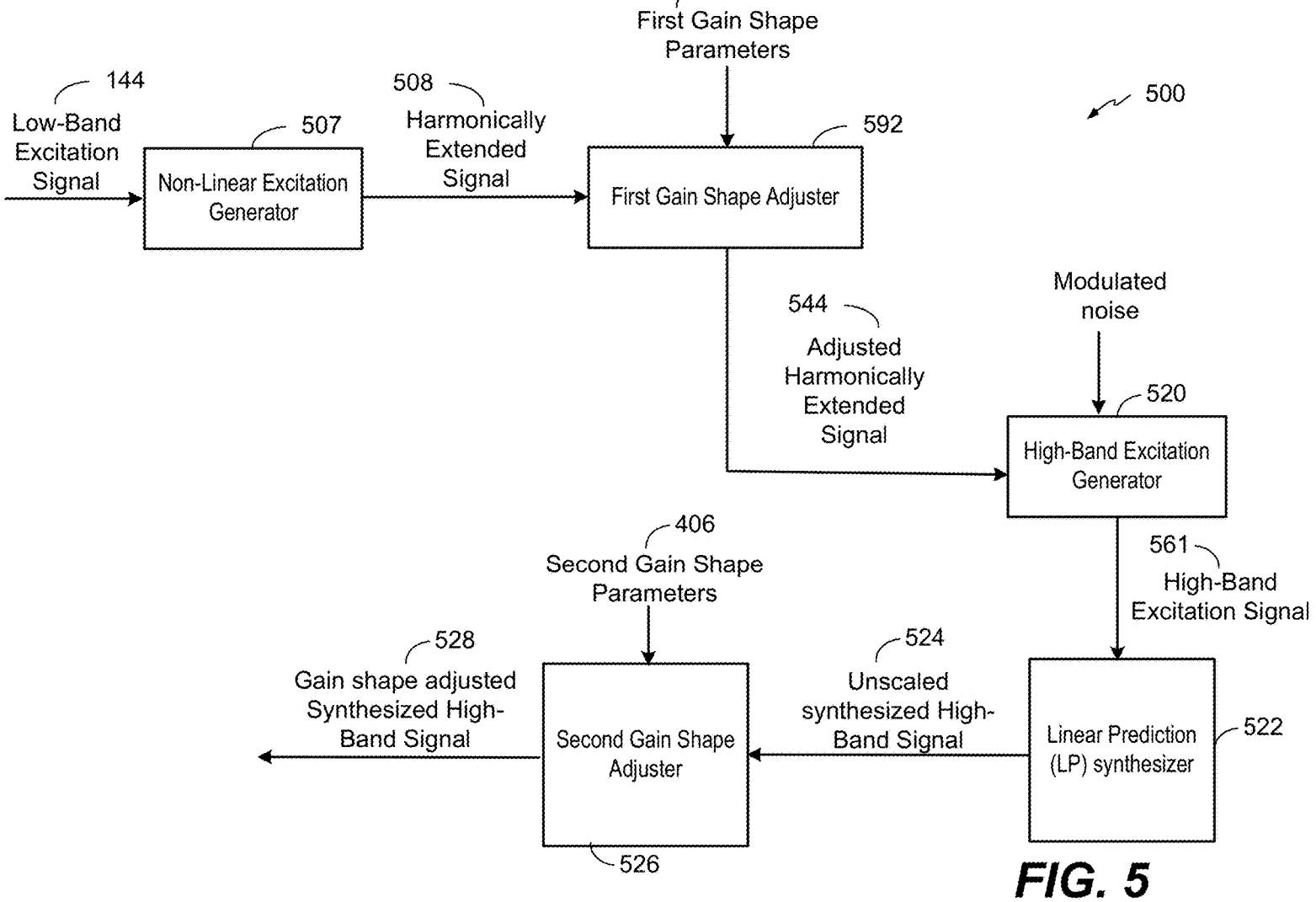
FIG. 5 is a diagram to illustrate a particular embodiment of a system that is operable to reproduce an audio signal using gain shape parameters.

Referring to FIG. 5, a particular embodiment of a system 500 that is operable to reproduce an audio signal using gain shape parameters is shown. The system 500 includes a non-linear excitation generator 507, a first gain shape adjuster 592, a high-band excitation generator 520, a linear prediction (LP) synthesizer 522, and a second gain shape adjuster 526. In a particular embodiment, the system 500 may be integrated into a decoding system or apparatus (e.g., in a wireless telephone, a CODEC, or a DSP). In other particular embodiments, the system 500 may be integrated into a set top box, a music player, a video player, an entertainment unit, a navigation device, a communications device, a PDA, a fixed location data unit, or a computer.

The non-linear excitation generator 507 may be configured to receive the low-band excitation signal 144 of FIG. 1. For example, the low-band bit stream 142 of FIG. 1 may include data representing the low-band excitation signal 144, and may be transmitted to the system 500 as the bit stream 199. The non-linear excitation generator 507 may be configured to generate a second harmonically extended signal 508 based on the low-band excitation signal 144. For example, the non-linear excitation generator 507 may perform an absolute-value operation or a square operation on frames (or sub-frames) of the low-band excitation signal 144 to generate the second harmonically extended signal 508. In a particular embodiment, the non-linear excitation generator 507 may operate in a substantially similar manner as the non-linear excitation generator 207 of FIG. 2. The second harmonically extended signal 508 may be provided to the first gain shape adjuster 592.

First gain shape parameters, such as the first gain shape parameters 242 of FIG. 2, may also be provided to the first gain shape adjuster 592. For example, the high-band side information 172 of FIG. 1 may include data representing the first gain shape parameters 242 and may be transmitted to the system 500. The first gain shape adjuster 592 may be configured to adjust the second harmonically extended signal 508 based on the first gain shape parameters 242 to generate a second adjusted harmonically extended signal 544. In a particular embodiment, the first gain shape adjuster 592 may operate in a substantially similar manner as the first gain shape adjuster 192 of FIGS. 1-2. The second adjusted harmonically extended signal 544 may be provided to the high-band excitation generator 520.

The high-band excitation generator 520 may generate a second high-band excitation signal 561 based on the second adjusted harmonically extended signal 544. For example, the high-band excitation generator 520 may include an envelope tracker, a noise combiner, a first combiner, a second combiner, and a mixer. In a particular embodiment, the components of the high-band excitation generator 520 may operate in a substantially similar manner as the envelope tracker 202 of FIG. 2, the noise combiner 240 of FIG. 2, the first combiner 254 of FIG. 2, the second combiner 256 of FIG. 2, and the mixer 211 of FIG. 2. The second high-band excitation signal 561 may be provided to the linear prediction synthesizer 522.

The linear prediction synthesizer 522 may be configured to receive the second high-band excitation signal 561 and to perform a linear prediction synthesis operation on the second high-band excitation signal 561 to generate a second synthesized high-band signal 524. In a particular embodiment, the linear prediction synthesizer 522 may operate in a substantially similar manner as the linear prediction synthesizer 402 of FIG. 4. The second synthesized high-band signal 524 may be provided to the second gain shape adjuster 526.

Second gain shape parameters, such as the second gain shape parameters 406 of FIG. 4, may also be provided to the second gain shape adjuster 526. For example, the high-band side information 172 of FIG. 1 may include data representing the second gain shape parameters 406 and may be transmitted to the system 500. The second gain shape adjuster 526 may be configured to adjust the second synthesized high-band signal 524 based on the second gain shape parameters 406 to generate a second adjusted synthesized high-band signal 528. In a particular embodiment, the second gain shape adjuster 526 may operate in a substantially similar manner as the second gain shape adjuster 196 of FIGS. 1 and 4. In a particular embodiment, the second adjusted synthesized high-band signal 528 may be a reproduced version of the high-band signal 124 of FIG. 1.

The system 500 of FIG. 5 may reproduce the high-band signal 124 using the high-band excitation signal 144, the first gain shape parameters 242, and the second gain shape parameters 406. Using the gain shape parameters 242, 406 may improve accuracy of reproduction by adjusting the second harmonically extended signal 508 and the second synthesized high-band signal 524 based on temporal evolutions of energy detected at the speech encoder.

Figure 6:
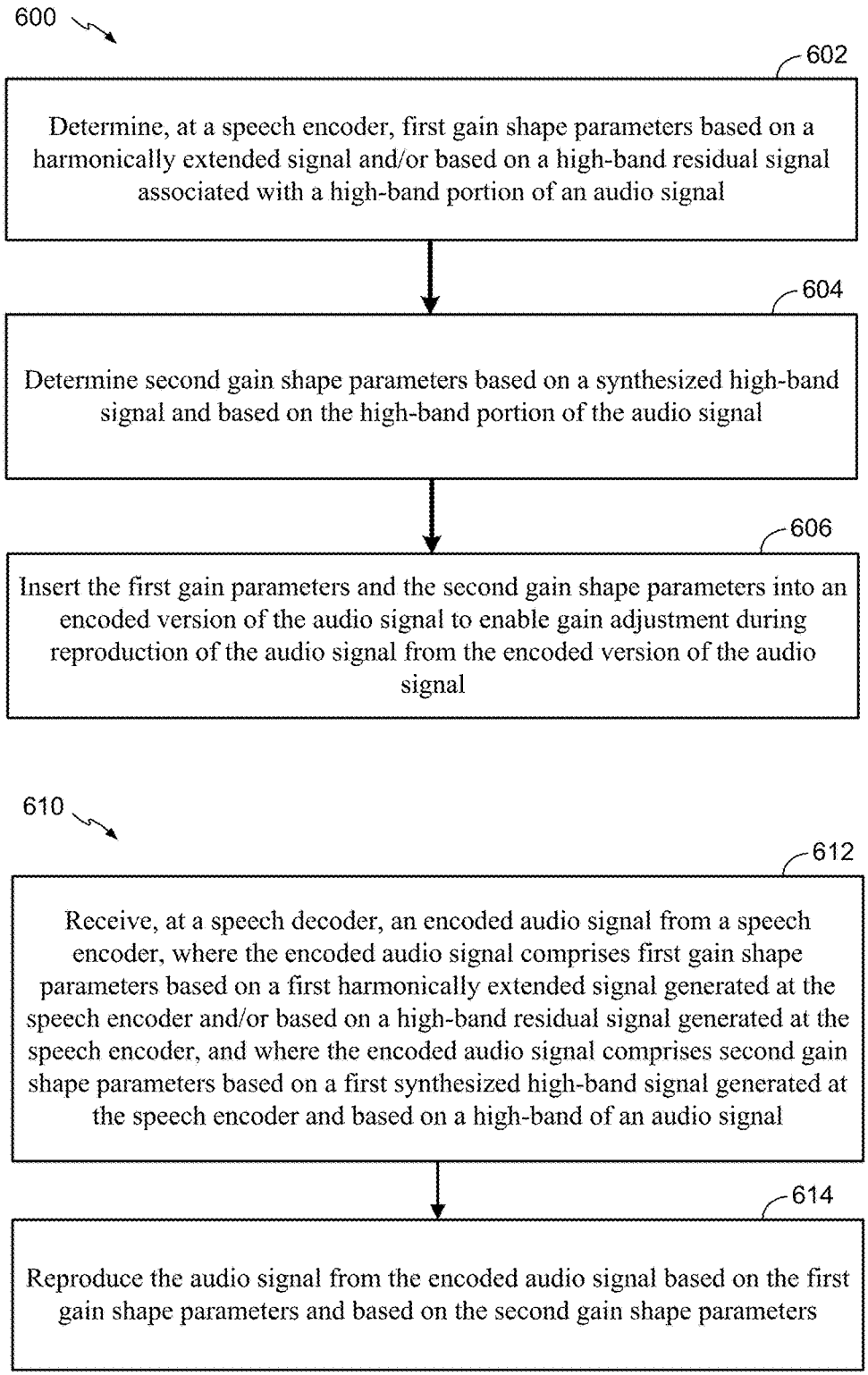
FIG. 6 is flowchart to illustrate particular embodiments of methods for using gain estimations for high-band reconstruction.

Referring to FIG. 6, flowcharts of particular embodiments of methods 600, 610 of using gain estimations for high-band reconstruction are shown. The first method 600 may be performed by the systems 100-200 of FIGS. 1-2 and the system 400 of FIG. 4. The second method 610 may be performed by the system 500 of FIG. 5.

The first method 600 includes determining, at a speech encoder, first gain shape parameters based on a harmonically extended signal and/or based on a high-band residual signal associated with a high-band portion of an audio signal, at 602. For example, the first gain shape estimator 190 of FIG. 1 may determine first gain shape parameters (e.g., the first gain shape parameters 242 of FIG. 2) based on a harmonically extended signal (e.g., the harmonically extended signal 208 of FIG. 2) and/or the high-band residual of the high-band signal 124.

The method 600 may also include determining second gain shape parameters based on a synthesized high-band signal and based on the high-band portion of the audio signal, at 604. For example, the second gain shape estimator 194 may determine second gain shape parameters 406 based on the synthesized high-band signal 404 and the high-band signal 124.

The first gain shape parameters and the second gain shape parameters may be inserted into an encoded version of the audio signal to enable gain adjustment during reproduction of the audio signal from the encoded version of the audio signal, at 606. For example, the high-band side information 172 of FIG. 1 may include the first gain shape parameters 242 and the second gain shape parameters 406. The multiplexer 180 may insert the first gain shape parameters 242 and the second gain shape parameters 406 into the bit stream 199, and the bit stream 199 may be transmitted to a decoder (e.g., the system 500 of FIG. 5). The first gain shape adjuster 592 of FIG. 5 may adjust the harmonically extended signal 508 based on the first gain shape parameter 242 to generate the second adjusted harmonically extended signal 544. The second high-band excitation signal 561 is at least partially based on the second adjusted harmonically extended signal 544. Additionally, the second gain shape adjuster 526 of FIG. 5 may adjust the synthesized high-band signal 524 based on the second gain shape parameters 406 to reproduce a version of the high-band signal 124.

The second method 610 may include receiving, at a speech decoder, an encoded audio signal from a speech encoder, at 612. The encoded audio signal may include the first gain shape parameters 242 based on the harmonically extended signal 208 generated at the speech encoder and/or the high-band residual signal 224 generated at the speech encoder. The encoded audio signal may also include the second gain shape parameters 406 based on the synthesized high-band signal 404 and the high-band signal 124.

An audio signal may be reproduced from the encoded audio signal based on the first gain shape parameters and based on the second gain shape parameters, at 614. For example, the first gain shape adjuster 592 of FIG. 5 may adjust the harmonically extended signal 508 based on the first gain shape parameters 242 to generate the second adjusted harmonically extended signal 544. The high-band excitation generator 520 of FIG. 5 may generate the second high-band excitation signal 561 based on the second adjusted harmonically extended signal 544. The linear prediction synthesizer 522 may perform a linear prediction synthesis operation on the second high-band excitation signal 561 to generate the second synthesized high-band signal 524, and the second gain shape adjuster 526 may adjust the second synthesized high-band signal 524 based on the second gain shape parameters 406 to generate a second adjusted synthesized high-band signal 528 (e.g., the reproduced audio signal).

The methods 600, 610 of FIG. 6 may improve a sub-frame-by-sub-frame energy correlation (e.g., improve a temporal evolution) between a harmonically extended low-band excitation of the audio signal 102 and a high-band residual of the input audio signal 102. For example, during a first gain stage, the first gain shape estimator 190 and the first gain shape adjuster 192 may adjust the harmonically extended low-band excitation based on first gain parameters to model the harmonically extended low-band excitation based on the residual of the high-band. The methods 600, 610 may also improve a sub-frame-by-sub-frame energy correlation between the high-band signal 124 and a synthesized version of the high-band signal 124. For example, during a second gain stage, the second gain shape estimator 194 and the second gain shape adjuster 196 may adjust the synthesized version of the high-band signal 124 based on second gain parameters to model the synthesized version of the high-band signal 124 based on the high-band signal 124.

In particular embodiments, the methods 600, 610 of FIG. 6 may be implemented via hardware (e.g., a FPGA device, an ASIC, etc.) of a processing unit, such as a central processing unit (CPU), a digital signal processor (DSP), or a controller, via a firmware device, or any combination thereof. As an example, the methods 600, 610 of FIG. 6 can be performed by a processor that executes instructions, as described with respect to FIG. 7.

Figure 7:
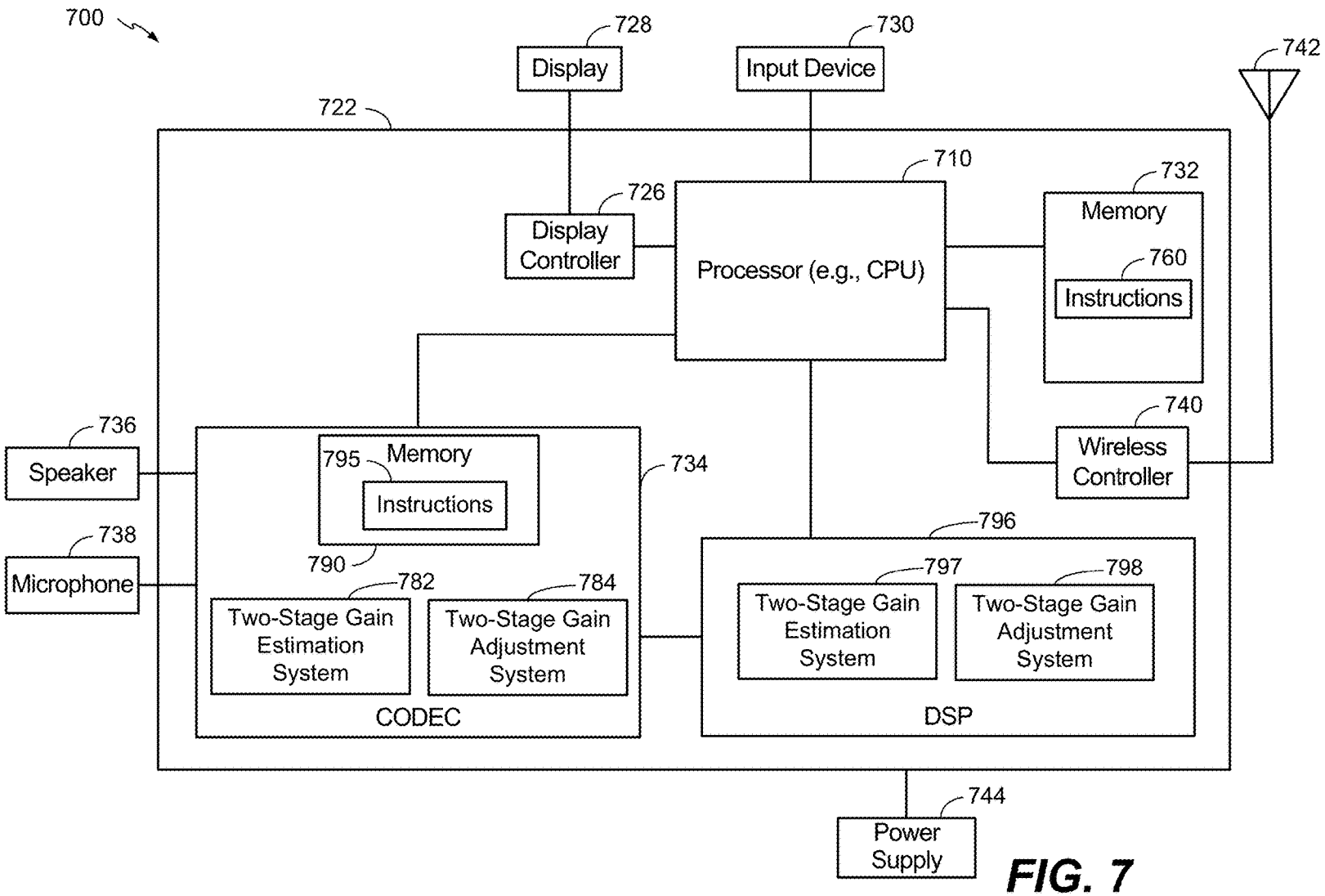
FIG. 7 is a block diagram of a wireless device operable to perform signal processing operations in accordance with the systems and methods of FIGS. 1-6.

Referring to FIG. 7, a block diagram of a particular illustrative embodiment of a wireless communication device is depicted and generally designated 700. The device 700 includes a processor 710 (e.g., a CPU) coupled to a memory 732. The memory 732 may include instructions 760 executable by the processor 710 and/or a CODEC 734 to perform methods and processes disclosed herein, such as the methods 600, 610 of FIG. 6.

In a particular embodiment, the CODEC 734 may include a two-stage gain estimation system 782 and a two-stage gain adjustment system 784. In a particular embodiment, the two-stage gain estimation system 782 includes one or more components of the system 100 of FIG. 1, one or more components of the system 200 of FIG. 2, and/or one or more components of the system 400 of FIG. 4. For example, the two-stage gain estimation system 782 may perform encoding operations associated with the systems 100-200 of FIG. 2, the system 400 of FIG. 4, and the method 600 of FIG. 6. In a particular embodiment, the two-stage gain adjustment system 784 may include one or more components of the system 500 of FIG. 5. For example, the two-stage gain adjustment system 784 may perform decoding operations associated with the system 500 of FIG. 5 and the method 610 of FIG. 6. The two-stage gain estimation system 782 and/or the two-stage gain adjustment system 784 may be implemented via dedicated hardware (e.g., circuitry), by a processor executing instructions to perform one or more tasks, or a combination thereof.

As an example, the memory 732 or a memory 790 in the CODEC 734 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 760 or the instructions 795) that, when executed by a computer (e.g., a processor in the CODEC 734 and/or the processor 710), may cause the computer to perform at least a portion of one of the methods 600, 610 of FIG. 6. As an example, the memory 732 or the memory 790 in the CODEC 734 may be a non-transitory computer-readable medium that includes instructions (e.g., the instructions 760 or the instructions 795, respectively) that, when executed by a computer (e.g., a processor in the CODEC 734 and/or the processor 710), cause the computer perform at least a portion of one of the method 600, 610 of FIG. 6.

The device 700 may also include a DSP 796 coupled to the CODEC 734 and to the processor 710. In a particular embodiment, the DSP 796 may include a two-stage gain estimation system 797 and a two-stage gain adjustment system 798. The two-stage gain estimation system 797 may include one or more components of the system 100 of FIG. 1, one or more components of the system 200 of FIG. 2, and/or one or more components of the system 400 of FIG. 4. For example, the two-stage gain estimation system 797 may perform encoding operations associated with the systems 100-200 of FIG. 2, the system 400 of FIG. 4, and the method 600 of FIG. 6. The two-stage gain adjustment system 798 may include one or more components of the system 500 of FIG. 5. For example, the two-stage gain adjustment system 798 may perform decoding operations associated with the system 500 of FIG. 5 and the method 610 of FIG. 6. The two-stage gain estimation system 797 and/or the two-stage gain adjustment system 798 may be implemented via dedicated hardware (e.g., circuitry), by a processor executing instructions to perform one or more tasks, or a combination thereof.

FIG. 7 also shows a display controller 726 that is coupled to the processor 710 and to a display 728. The CODEC 734 may be coupled to the processor 710, as shown. A speaker 736 and a microphone 738 can be coupled to the CODEC 734. For example, the microphone 738 may generate the input audio signal 102 of FIG. 1, and the CODEC 734 may generate the output bit stream 199 for transmission to a receiver based on the input audio signal 102. As another example, the speaker 736 may be used to output a signal reconstructed by the CODEC 734 from the output bit stream 199 of FIG. 1, where the output bit stream 199 is received from a transmitter. FIG. 7 also indicates that a wireless controller 740 can be coupled to the processor 710 and to a wireless antenna 742.

In a particular embodiment, the processor 710, the display controller 726, the memory 732, the CODEC 734, the DSP 796, and the wireless controller 740 are included in a system-in-package or system-on-chip device (e.g., a mobile station modem (MSM)) 722. In a particular embodiment, an input device 730, such as a touchscreen and/or keypad, and a power supply 744 are coupled to the system-on-chip device 722. Moreover, in a particular embodiment, as illustrated in FIG. 7, the display 728, the input device 730, the speaker 736, the microphone 738, the antenna 742, and the power supply 744 are external to the system-on-chip device 722. However, each of the display 728, the input device 730, the speaker 736, the microphone 738, the antenna 742, and the power supply 744 can be coupled to a component of the system-on-chip device 722, such as an interface or a controller.

In conjunction with the described embodiments, a first apparatus is disclosed that includes means for determining first gain shape parameters based on a harmonically extended signal and/or based on a high-band residual signal associated with a high-band portion of an audio signal. For example, the means for determining the first gain shape parameters may include the first gain shape estimator 190 of FIGS. 1-2, the frame identification module 214 of FIG. 2, the two-stage gain estimation system 782 of FIG. 7, the two-stage gain estimation system 797 of FIG. 7, one or more devices configured to determine the first gain shape parameters (e.g., a processor executing instructions at a non-transitory computer readable storage medium), or any combination thereof.

The first apparatus may also include means for determining second gain shape parameters based on a synthesized high-band signal and based on the high-band portion of the audio signal. For example, the means for determining the second gain shape parameters may include the second gain shape estimator 194 of FIGS. 1 and 4, the two-stage gain estimation system 782 of FIG. 7, the two-stage gain estimation system 797 of FIG. 7, one or more devices configured to determine the second gain parameters, (e.g., a processor executing instructions at a non-transitory computer readable storage medium), or any combination thereof.

The first apparatus may also include means for inserting the first gain shape parameters and the second gain shape parameters into an encoded version of the audio signal to enable gain adjustment during reproduction of the audio signal from the encoded version of the audio signal. For example, the means for inserting the first gain shape parameters and the second gain shape parameters into the encoded version of the audio signal may include the multiplexer 180 of FIG. 1, the two-stage gain estimation system 782 of FIG. 7, the two-stage gain estimation system 797 of FIG. 7, one or more devices configured to insert the first gain parameters into the encoded version of the audio signal, (e.g., a processor executing instructions at a non-transitory computer readable storage medium), or any combination thereof.

In conjunction with the described embodiments, a second apparatus is disclosed that includes means for receiving an encoded audio signal from a speech encoder. The encoded audio signal includes first gain shape parameters based on a first harmonically extended signal generated at the speech encoder and based on a high-band residual signal generated at the speech encoder. The encoded audio signal also includes second gain shape parameters based on a first synthesized high-band signal generated at the speech encoder and based on a high-band of an audio signal. For example, the means for receiving the encoded audio signal may include the non-linear excitation generator 507 of FIG. 5, the first gain shape estimator 592 of FIG. 5, the second gain shape estimator 526 of FIG. 5, the two-stage gain adjustment system 784 of FIG. 7, the two-stage gain adjustment system 798 of FIG. 7, one or more devices configured to determine the receive the encoded audio signal, (e.g., a processor executing instructions at a non-transitory computer readable storage medium), or any combination thereof.

The second apparatus may also include means for reproducing the audio signal from the encoded audio signal based on the first gain shape parameters and based on the second gain shape parameters. For example, the means for reproducing the audio signal may include the non-linear excitation generator 507 of FIG. 5, the first gain shape estimator 592 of FIG. 5, the high-band excitation generator 520 of FIG. 5, the linear prediction coefficient synthesizer 522 of FIG. 5, the second gain shape estimator 526 of FIG. 5, the two-stage gain adjustment system 784 of FIG. 7, the two-stage gain adjustment system 798 of FIG. 7, one or more devices configured to reproduce the audio signal, (e.g., a processor executing instructions at a non-transitory computer readable storage medium), or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method comprising:

performing a first determination, at a speech encoder, of first gain shape parameters based at least in part on energy levels of a first plurality of sub-frames of a harmonically extended signal, based at least in part on energy levels of a second plurality of sub-frames of a high-band residual signal associated with a high-band portion of an audio signal, or any combination thereof;

generating a high-band excitation signal based at least in part on the first gain shape parameters;

generating a synthesized high-band signal based on the high-band excitation signal;

performing a second determination of second gain shape parameters based on the synthesized high-band signal and based on the high-band portion of the audio signal; and inserting the first gain shape parameters and the second gain shape parameters into an encoded version of the audio signal.

2. The method of claim 1, wherein the first determination is performed at a first gain shape estimator stage, wherein the second determination is performed at a second gain shape estimator stage, and wherein the second gain shape estimator stage differs from the first gain shape estimator stage.

3. The method of claim 1, wherein the first determination, the second determination, and the inserting are performed at a device that comprises a mobile communication device.

4. The method of claim 1, wherein the first gain shape parameters are determined in a linear prediction residual domain, wherein the second gain shape parameters are determined in a linear prediction synthesis domain, and wherein the harmonically extended signal is generated from a low-band portion of the audio signal through non-linear harmonic extension.

5. The method of claim 1, further comprising:

adjusting the harmonically extended signal based on the first gain shape parameters to generate a modified harmonically extended signal;

wherein generating the high-band excitation signal is at least partially based on the modified harmonically extended signal;

performing a linear prediction synthesis operation on the high-band excitation signal to generate the synthesized high-band signal; and adjusting the synthesized high-band signal based on the second gain shape parameters.

6. The method of claim 5, wherein the high-band excitation signal is generated based on the modified harmonically extended signal and a modulated noise signal.

7. The method of claim 1, further comprising:

sampling a low-band frame of the harmonically extended signal to generate the first plurality of sub-frames; or sampling a corresponding high-band frame of the high-band residual signal to generate the second plurality of sub-frames.

8. The method of claim 7, wherein adjusting the harmonically extended signal comprises scaling a particular sub-frame of the first plurality of sub-frames to approximate an energy level of a corresponding sub-frame of the second plurality of sub-frames.

9. The method of claim 7, wherein the second plurality of sub-frames includes a first number of sub-frames in response to a determination that the high-band frame is a voiced frame, and wherein the second plurality of sub-frames includes a second number of sub-frames that is less than the first number of sub-frames in response to a determination that the high-band frame is not a voiced frame.

10. The method of claim 7, wherein the first plurality of sub-frames and the second plurality of sub-frames include the same number of sub-frames for both a voiced frame and an unvoiced frame, wherein the first plurality of sub-frames and the second plurality of sub-frames include four sub-frames if a low band core sample rate is 12.8 kilohertz (kHz), and wherein the first plurality of sub-frames and the second plurality of sub-frames include five sub-frames if the low band core sample rate is 16 kHz.

11. The method of claim 1, wherein the first determination, the second determination, and the inserting are performed at a device that comprises a fixed location data unit.

12. An apparatus comprising:

a first gain shape estimator configured to determine first gain shape parameters at least in part based on energy levels of a first plurality of sub-frames of a harmonically extended signal, based at least in part on energy levels of a second plurality of sub-frames of a high-band residual signal associated with a high-band portion of an audio signal, or any combination thereof;

a high-band excitation generator configured to generate a high-band excitation signal based at least in part on the first gain shape parameters;

a linear prediction synthesizer configured to perform a linear prediction synthesis operation on the high-band excitation signal to generate a synthesized high-band signal;

a second gain shape estimator configured to determine second gain shape parameters based on the synthesized high-band signal and based on the high-band portion of the audio signal; and circuitry configured to insert the first gain shape parameters and the second gain shape parameters into an encoded version of the audio signal.

13. The apparatus of claim 12, wherein the first gain shape parameters are determined in a linear prediction residual domain, wherein the circuitry includes a multiplexer, and wherein the harmonically extended signal is generated from a low-band portion of the audio signal through non-linear harmonic extension.

14. The apparatus of claim 12, further comprising:

an antenna; and a receiver coupled to the antenna and configured to receive the audio signal.

15. The apparatus of claim 14, further comprising a processor coupled to the first gain shape estimator, the second gain shape estimator, the circuitry, and the receiver, wherein the processor is integrated into a mobile communication device.

16. The apparatus of claim 14, further comprising a processor coupled to the first gain shape estimator, the second gain shape estimator, the circuitry, and the receiver, wherein the processor is integrated into a fixed location data unit.

17. The apparatus of claim 12, further comprising a first gain shape adjuster configured to adjust the harmonically extended signal based on the first gain shape parameters to generate a modified harmonically extended signal, wherein the first gain shape estimator is further configured to:

sample a low-band frame of the harmonically extended signal to generate the first plurality of sub-frames; or sample a corresponding high-band frame of the high-band residual signal to generate the second plurality of sub-frames.

18. The apparatus of claim 17, wherein the first plurality of sub-frames includes a first number of sub-frames in response to a determination that the high-band frame is a voiced frame, and wherein the first plurality of sub-frames includes a second number of sub-frames that is less than the first number of sub-frames in response to a determination that the high-band frame is not a voiced frame.

19. The apparatus of claim 17, wherein the first plurality of sub-frames includes sixteen sub-frames in response to a determination that the high-band frame is a voiced frame.

20. The apparatus of claim 17, wherein the high-band excitation generator is configured to generate the high-band excitation signal based on the modified harmonically extended signal and a modulated noise signal.

21. The apparatus of claim. 12, further comprising:

a first gain shape adjuster configured to adjust the harmonically extended signal based on a low-band frame of the harmonically extended signal; and a second gain shape adjuster configured to adjust the synthesized high-band signal based on the second gain shape parameters.

22. A method comprising:

receiving, at a speech decoder, an encoded audio signal from a speech encoder, wherein the encoded audio signal comprises:

first gain shape parameters based on a first determination, the first determination based at least in part on energy levels of a first plurality of sub-frames of a first harmonically extended signal generated at the speech encoder, based at least in part on energy levels of a second plurality of sub-frames of a high-band residual signal generated at the speech encoder, or any combination thereof; and second gain shape parameters based on a second determination, the second determination based on a first synthesized high-band signal generated at the speech encoder and based on a high-band portion of an audio signal, wherein the synthesized high-band signal is based on a first high-band excitation signal that is based at least in part on the first gain shape parameters; and reproducing the audio signal from the encoded audio signal based on the first gain shape parameters and based on the second gain shape parameters.

23. The method of claim 22, wherein reproducing the audio signal at the speech decoder comprises:

generating a second harmonically extended signal based on non-linearly extending a low-band excitation of the encoded audio signal;

adjusting the second harmonically extended signal based on the first gain shape parameters to obtain a modified second harmonically extended signal;

generating a second high-band excitation signal based on the modified second harmonically extended signal;

performing a linear prediction synthesis operation on the second high-band excitation signal to generate a second synthesized high-band signal; and adjusting the second synthesized high-band signal based on the second gain shape parameters.

24. The method of claim 22, wherein the receiving and the reproducing are performed at a device that comprises a mobile communication device.

25. The method of claim 22, wherein the receiving and the reproducing are performed at a device that comprises a fixed location data unit.

26. A system including a speech decoder, the speech decoder configured to:

receive an encoded audio signal from a speech encoder, wherein the encoded audio signal comprises:

first gain shape parameters based on a first determination, the first determination based at least in part on energy levels of a first plurality of sub-frames of a first harmonically extended signal generated at the speech encoder, based at least in part on energy levels of a second plurality of sub-frames of a high-band residual signal generated at the speech encoder, or any combination thereof; and second gain shape parameters based on a second determination, the second determination based on a first synthesized high-band signal generated at the speech encoder and based on a high-band portion of an audio signal, wherein the first synthesized high-band signal is based on a first high-band excitation signal that is based at least in part on the first gain shape parameters; and reproduce the audio signal from the encoded audio signal based on the first gain shape parameters and based on the second gain shape parameters.

27. The system of claim 26, further comprising:

an antenna; and a receiver coupled to the antenna and configured to receive the encoded audio signal.

28. The system of claim 27, further comprising a processor coupled to the receiver, wherein the processor and the receiver are integrated into a mobile communication device.

29. The system of claim 27, further comprising a processor coupled to the receiver, wherein the processor and the receiver are integrated into a fixed location data unit.

30. The system of claim 26, comprising:

a non-linear excitation generator configured to generate a second harmonically extended signal based on a low-band excitation of the encoded audio signal;

a first gain shape adjuster configured to adjust the second harmonically extended signal based on the first gain shape parameters to obtain a second modified harmonically extended signal; and a high-band excitation generator configured to generate a second high-band excitation signal based on the modified second harmonically extended signal.

* * * * *